US008701916B2

(12) United States Patent
Cook et al.

(10) Patent No.: US 8,701,916 B2
(45) Date of Patent: Apr. 22, 2014

(54) PLASTIC PAN AND DRAIN PLUG ASSEMBLY

(75) Inventors: Chris M. Cook, McKenzie, TN (US); Michael Puckett, Paris, TN (US)

(73) Assignee: Dana Automotive Systems Group, LLC, Maumee, OH (US)

( * ) Notice: Subject to any disclaimer, the term of this patent is extended or adjusted under 35 U.S.C. 154(b) by 629 days.

(21) Appl. No.: 12/804,043

(22) Filed: Jul. 13, 2010

(65) Prior Publication Data

US 2011/0011865 A1 Jan. 20, 2011

Related U.S. Application Data

(60) Provisional application No. 61/270,837, filed on Jul. 14, 2009.

(51) Int. Cl.
*B65D 53/00* (2006.01)

(52) U.S. Cl.
USPC ..... 220/235; 220/573; 220/234

(58) Field of Classification Search
USPC ..... 220/288, 573, 233, 235, 571, 234; 184/106
See application file for complete search history.

(56) References Cited

U.S. PATENT DOCUMENTS

| | | | | |
|---|---|---|---|---|
| 4,930,657 | A | 6/1990 | Walker | |
| 5,420,557 | A | 5/1995 | Chern et al. | |
| 5,626,472 | A | 5/1997 | Pennetta | |
| 5,680,954 | A | 10/1997 | Arnold et al. | |
| 6,905,040 | B2 | 6/2005 | Hilger et al. | |
| 7,427,181 | B2 | 9/2008 | Denton et al. | |
| 2007/0170390 | A1 | 7/2007 | Jessberger | |
| 2008/0000724 | A1 | 1/2008 | Stlaske et al. | |
| 2008/0135340 | A1 * | 6/2008 | Schlicker et al. | 184/106 |
| 2010/0006376 | A1 * | 1/2010 | Jessberger et al. | 184/1.5 |

FOREIGN PATENT DOCUMENTS

| | | | |
|---|---|---|---|
| DE | 38 17 981 | C1 | 12/1988 |
| DE | 296 15 509 | U | 11/1996 |
| DE | 200 16 445 | U | 3/2002 |
| DE | 101 60 901 | A1 | 8/2003 |
| DE | 10 2005 008 047 | A1 | 3/2006 |
| DE | 10 2007 009 488 | A1 | 8/2008 |
| DE | 10 2008 014 688 | A1 | 9/2009 |
| FR | 2549532 | A1 | 1/1985 |
| WO | WO 2008/068301 | A1 | 6/2008 |

* cited by examiner

*Primary Examiner* — Anthony Stashick
*Assistant Examiner* — Christopher McKinley
(74) *Attorney, Agent, or Firm* — Marshall & Melhorn, LLC

(57) ABSTRACT

A plastic pan and a plastic drain plug assembly is disclosed. The pan has upstanding walls, a bottom wall, an exterior surface and an interior surface. One of the walls has an opening extending through it. On the exterior, the opening has a circular raised collar with cutouts opposite each other and stop tabs located between the cutouts. On the interior, the opening has a circular raised non-threaded tubular wall. A portion of the non-threaded tubular wall has nibs projecting into the opening. The plug has a head portion, a body portion, an end portion. The head portion has an upstanding crown with downwardly extending tabs located opposite each other. The body portion has a circular groove, and a spiral groove. The end portion of the plug is tapered.

33 Claims, 4 Drawing Sheets

PLASTIC PAN AND DRAIN PLUG ASSEMBLY

RELATED APPLICATIONS

This application is a non-provisional application filed off of U.S. patent application Ser. No. 61/270,837 filed on Jul. 14, 2009, which is incorporated by reference in its entirety herein. This non-provisional application is being filed during the pendency of U.S. patent application Ser. No. 61/270,837.

FIELD OF THE INVENTION

The present invention relates to a plastic pan and drain plug assembly, primarily for use in automotive and industrial equipment.

SUMMARY OF THE INVENTION

The present invention is directed toward a plastic pan and a plastic drain plug assembly. The assembly may be used in any automotive or industrial application requiring fluid to be retained and changed. The assembly includes a plastic oil pan and plastic oil pan drain plug. The pan comprises upstanding walls, a bottom wall, an exterior surface and an interior surface. One of the walls has an opening extending from the exterior surface of the pan into the interior surface of the pan. The opening is defined on the exterior surface by a generally circular raised collar. The raised collar contains cutouts and stop tabs located between the cutouts. On the interior surface of the pan, the opening is defined by a non-threaded tubular wall. A portion of the non-threaded tubular wall has nibs projecting into the opening.

The plastic drain plug comprises a head portion, a body portion, an end portion and an o-ring. The head portion is made up of two areas of different diameter. The upper first portion includes an upstanding crown with downwardly extending tabs located opposite each other. The lower second portion is below the upper first portion and is smaller in diameter than the upper first portion. The body portion comprises a circular groove, for the o-ring, and a spiral groove. The end portion of the plug is tapered.

Accordingly, the subject invention provides a plastic pan and plastic drain plug assembly. The features of each when combined create a quick and inexpensive design to properly position the drain plug in the pan. Anti-rotation features also ensure that the drain plug remains in the locked position when inserted in the pan opening. The plastic assembly reduces costs and the weight of the pan and drain plug assembly.

BRIEF DESCRIPTION OF THE DRAWINGS

The above, as well as other advantages of the present invention will become readily apparent to those skilled in the art from the following detailed description when considered in the light of the accompanying drawings in which.

DETAILED DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1:
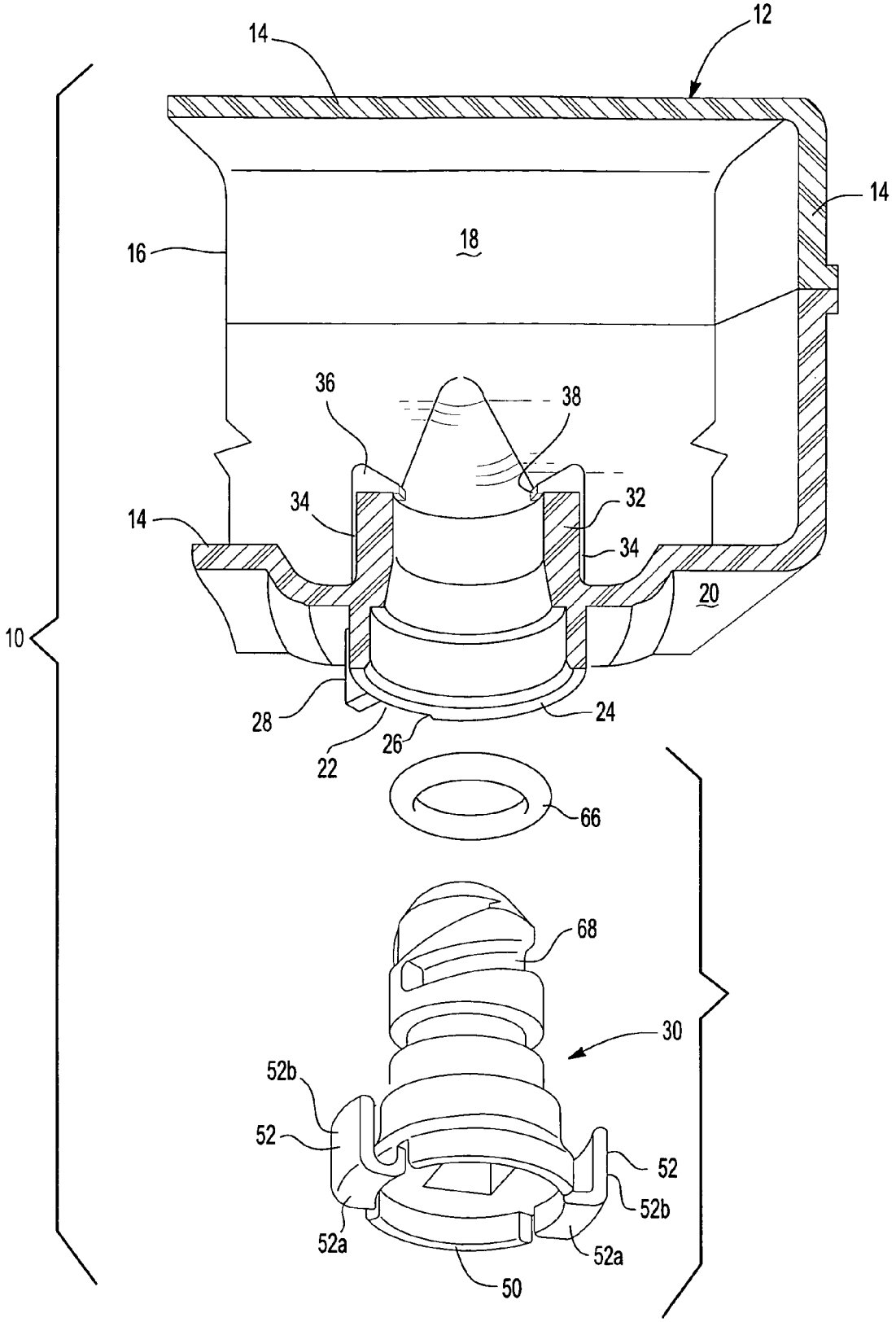
FIG. 1 is a cutaway view of one embodiment of a pan and a perspective view of a plug exploded from the pan.

Turning now to FIG. 1, one embodiment of a pan and drain plug assembly 10 of the present invention is depicted. The assembly 10 of the preferred embodiment comprises a plastic pan 12, which is defined by upstanding walls 14, a bottom wall 16 and an open top. The upstanding walls 14 may be flat, curved, or any combination of the aforementioned.

The preferred embodiment of the present invention discloses the pan 12 as generally rectangular in shape with four upstanding walls 14. However, it should be understood that the shape of the pan 12 and the number of upstanding walls 14 may vary depending on the particular application, size of the engine and space requirements within and beneath the engine compartment of a vehicle.

The pan 12 also comprises an interior surface 18 and an exterior surface 20 both of which are defined by the upstanding walls 14 and the bottom wall 16. The upstanding walls 14, bottom wall 16 and the interior 18 and exterior surfaces together define the pan 12 for storing fluid.

The type of fluid may vary depending on the application in which the assembly 10 is being used. In this particular embodiment, the pan 12 described is an oil pan for an internal combustion engine (not shown). Typically, oil pans are generally located below the engine, typically under the crankcase.

The pan 12 may house, or have placed within it, a pump (not shown) for circulating liquid out of the pan 12 back into the engine, and it may also block splashed fluid while the engine is running to create a sealed unit when assembled onto the engine. While this disclosure is hereinafter referred to and shown as an engine oil pan and drain plug assembly 10, it should be understood that the subject invention may be incorporated into other devices for automotive or industrial applications, such as a coolant tank or a transmission oil pan.

Figure 3:
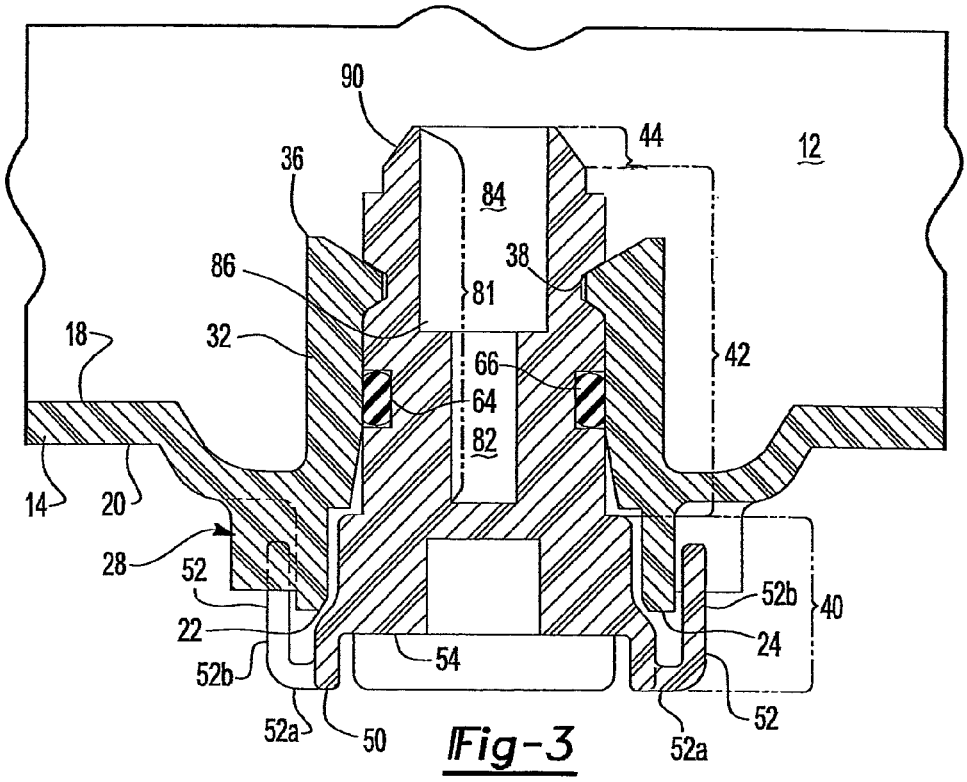
FIG. 3 is a cutaway side view of the drain plug inserted in the pan taken along lines 3-3 of FIG. 2.

As shown in FIGS. 1 and 3, the pan 12 comprises an opening 22 in one of the upstanding walls 14. The opening 22 extends from the exterior surface 20 through to the interior surface 18 of the pan 12. The preferred embodiment of the present invention discloses the opening 22 located on a flat upstanding wall 14 near the bottom wall 16; however, it is also within the scope of the invention for the opening 22 to be located at any arbitrary free position in the bottom wall 16. Placement of the opening 22 in an upstanding wall 14 near the bottom wall 16 assists in complete drainage of the fluid.

The opening 22 on the exterior surface 20 is defined by a generally circular raised collar 24. The raised collar 24 is unitary with the pan 12 and extends outwardly from the exterior surface 20 of the pan 12.

Figure 4:
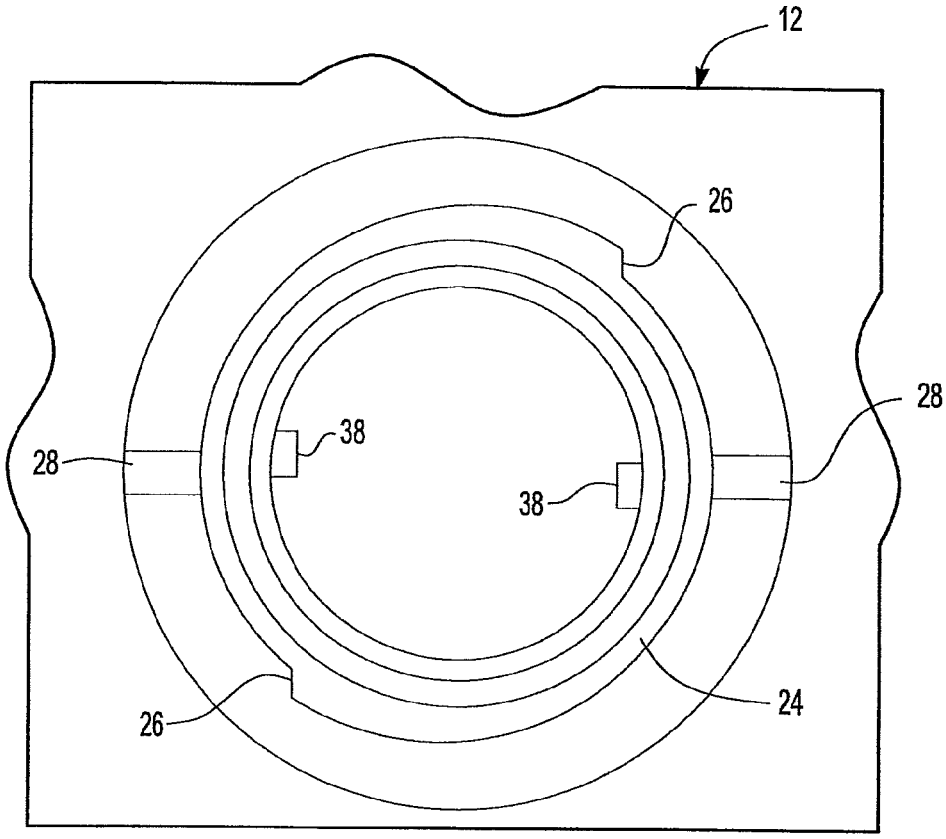
FIG. 4 is a top view of a pan opening for the drain plug.

The raised collar 24 comprises cutouts 26 and stop tabs 28. As shown in FIG. 4, there are two cutouts 26 and two stop tabs 28. However, it is within the scope of the present invention for the number of cutouts and tabs to vary, but at least one of each is required. When the number of cutouts 26 is greater than two, the term opposite is to be understood as being equally distributed around the perimeter of the collar.

The cutouts 26 extend along the entire height of the raised collar 24 and are generally located opposite each other. From where a cutout 26 begins, the outer diameter of the raised collar 24 gradually increases in thickness until it contacts the next cutout 26, at which point the thickness decreases and then gradually increases up to the next cutout 26. The cutouts 26 are depicted as angled portions in the outer diameter. The cutouts 26 act as an exterior locking feature to prevent a plug 30 from loosening due to vibration caused when an engine is in operation or even from simple vehicle motion.

Also as shown in FIG. 4 the stop tabs 28 are generally spaced equidistance from the cutouts 26. The stop tabs 28 as shown are rectangular in shape, but it is within the scope of the invention for them to be other shapes as well. The stop tabs 28 are unitary with the pan 12 and extend upwardly from the exterior surface 20 of the pan 12. The stop tabs 28 are also unitary with the raised collar 24 and extend radially outward from an outside diameter of the raised collar 24. The stop tabs 28 are recessed below the outermost edge of the raised collar 24, as shown in FIG. 3. The stop tabs 28 prevent over rotation or over tightening of the plug 30.

It is also within the scope of the present invention for the raised collar 24, cutouts 26 and stop tabs 28, to be shifted unitarily inward so that the raised collar 24, cutouts 26 and stop tabs 28 may be flush with or recessed into the upstanding wall 14.

The opening 22 on the interior surface 18 is defined by a non-threaded tubular wall 32, as depicted in FIGS. 1 and 3. The non-threaded tubular wall 32 is unitary with the pan 12 and extends inwardly from the interior surface 18 with its bottom edge terminating in a pan cavity. The outer surface of the non-threaded tubular wall 32 pointing to the interior of the oil pan is partially hemispherical in shape with two straight edges 34 located opposite each other and formed into the bottom wall 16. At least one nib 38 is located at the innermost edge of the opening 22 on a straight edge 34. In the preferred embodiment of the invention, two nibs 38 are shown which are spaced equidistance apart around the opening 22. The nibs 38 are generally triangular in shape; however, it is within the scope of the invention for the nibs 38 to be other shapes as well provided that the nibs 38 are thin in the area projecting into the opening 22. It is also within the scope of the present invention for the nibs 38 to extend from triangular raised projections 36, which may be located on the inner most edge of a straight edge 34. The two triangular raised projections 36, as shown in FIG. 3 are unitary with the straight edges 34 of the non-threaded tubular wall 32 outer surface, and the projections 36 provided added stability to the nibs 38. It is also within the scope of the invention for the projections 36 to be other shapes as well. A nib 38 is located on the end of the triangular projection 36 farthest from the bottom wall 16.

Figure 5:
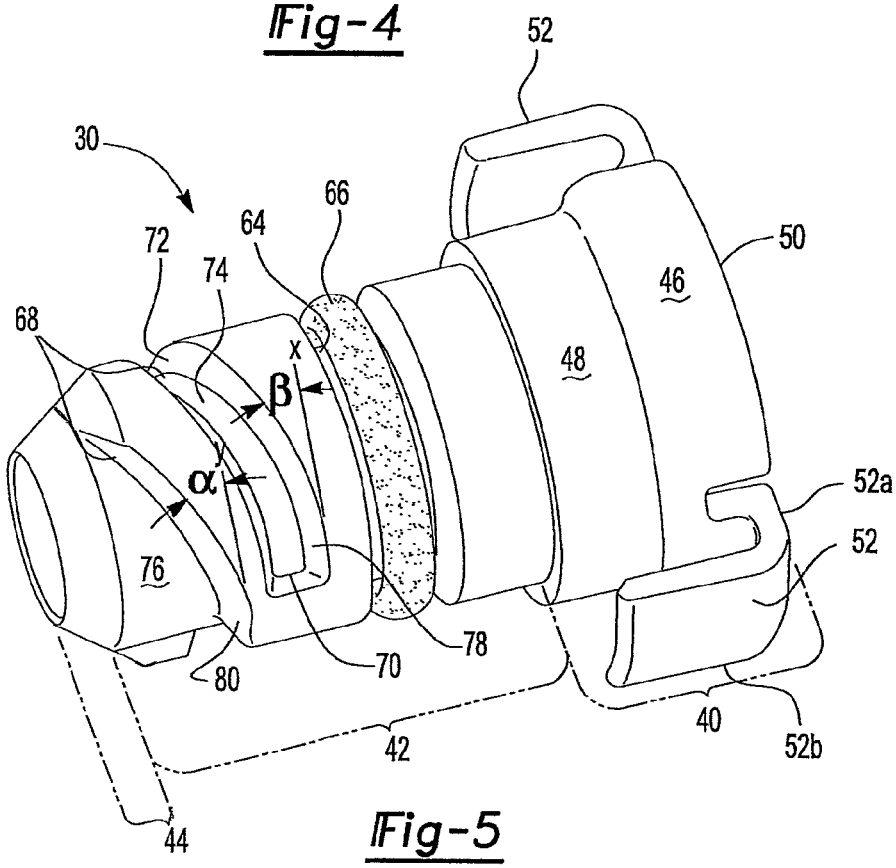
FIG. 5 is a perspective view of the drain plug.

The drain plug 30, as shown in FIGS. 3 and 5, comprises at least the following three sections: a head portion 40, a body portion 42, and an end portion 44. The head portion 40 comprises two portions, an upper first portion 46 and a lower second portion 48. The lower second portion 48 is smaller in diameter than the upper first portion 46. The upper first portion 46 comprises an upstanding crown 50 partially defined by downwardly extending tabs 52 located opposite each other. It is within the scope of the present invention for the number of downwardly extending tabs 52 to vary, but at least one is required. When the number of downwardly extending tabs 52 is greater than two, the term opposite is to be understood as being equally distributed around the perimeter of the crown 50.

The crown 50 may be continuous or noncontinous and it is unitary with the lower second portion 48. The downwardly extending tabs 52 are rectangular in shape and extend downwardly from the crown 50 and adjacent the lower second portion 48. The downwardly extending tabs 52 have a first flat portion 52*a* that is planar with the crown 50. The downwardly extending tabs 52 also have a second portion 52*b* that extends downwardly in a perpendicular fashion from the first flat portion 52*a*. The second portion 52*b* may also be slightly cambered. In the preferred embodiment, the crown 50 is partially slit adjacent to the downwardly extending tabs 52.

Figure 2:
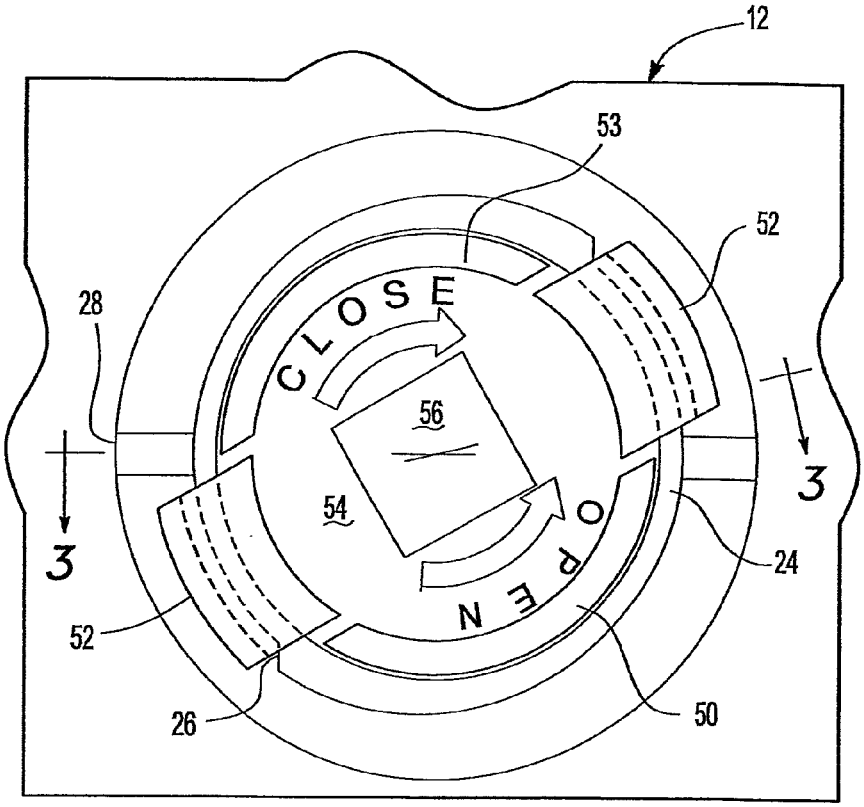
FIG. 2 is a top view of the drain plug located in the pan of FIG. 1.
Figure 6:
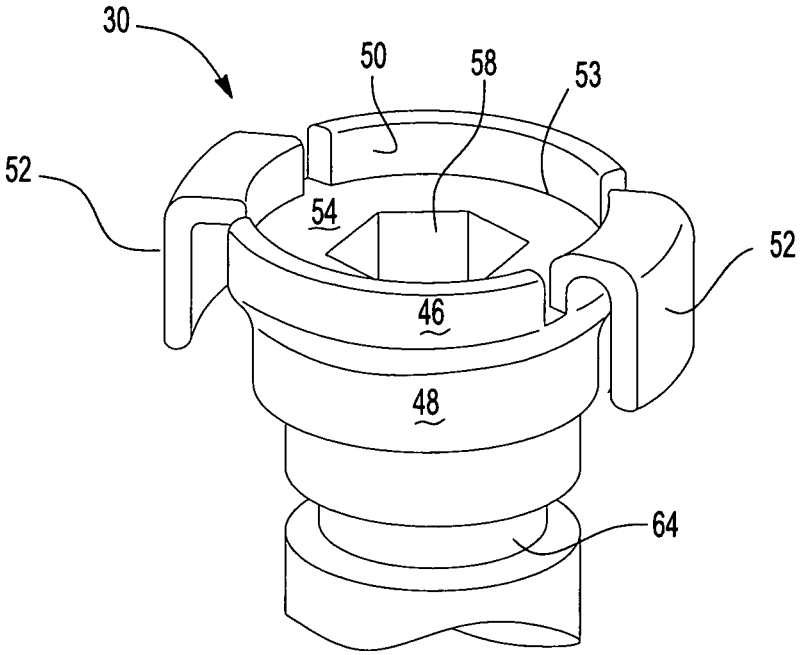
FIG. 6 is another embodiment of the top portion of the drain plug.
Figure 7:
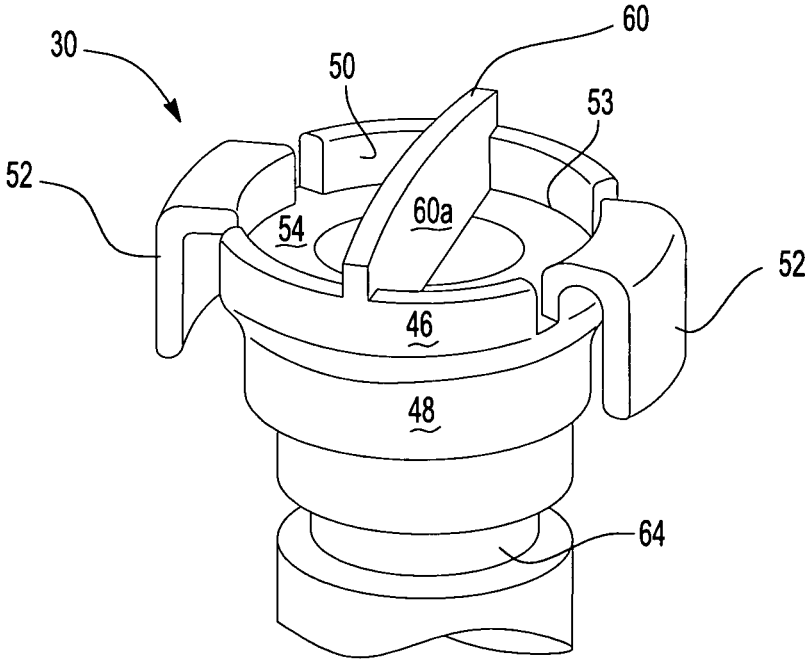
FIG. 7 is another embodiment of the top portion of the drain plug.

An inside diameter 53 of the crown 50 transitions downward and is joined to a planar portion 54, as shown in FIGS. 6 and 7. The head planar portion 54 is on the same plane as the bottom of the first upper portion 46, or the top of the lower second portion 48. As depicted in FIGS. 2 and 6, the planar portion 54 on the plug head portion 40 may have an indentation 56, 58. The indentation 56, 58 is generally centered within the planar portion 54, and as shown in FIG. 2, it may be square 56 in shape. However, it is within the scope of the invention for the indentation 58 to be other shapes, as shown in FIG. 6. The indentation 56, 58 may be used for inserting a tool (not shown) to open and close the plug 30.

It is also within the scope of the invention for the planar portion 54 to have a handle-type 60 feature, as shown FIG. 7. The handle 60 comprises planar sides 60*a* that are parallel to each other, and fixed perpendicular to the planar portion 54 of the head portion 40. The handle 60 is unitary and extends upward from the planar portion 54 of the head portion 40. The handle 60 may extend up higher than the top edge 50*a* of the crown 50. The handle 60 is designed so that it may be grasped by hand, and in such a way that the plug 30 may be turned in or out without the need for tools.

Returning now to FIGS. 3 and 5, the body portion 42 of the plug 30 is smaller in diameter than the lower second portion 48 of the head portion 40. The body portion 42 comprises a circular groove 64, for inserting an o-ring 66, and a spiral groove 68. The circular groove 64 may be located approximately one-third of the way down the body portion 42. The circular groove 64 is continuous and completely encircles the outer diameter of the body portion 42 of the plug 30. It is preferred that the circular groove 64 be deep enough for the o-ring 66 to partially extend past the outer diameter of the body portion 42 of the plug 30 to ensure proper sealing. The o-ring 66 creates a seal so that fluid does not leak out of the pan 12 when the plug 30 is inserted in to the pan opening 22.

The spiral groove 68 makes up approximately the lower two-thirds of the body portion 42 with the top of the spiral groove 68 beginning below the circular groove 64. A squarely shaped projection, or stop 70, is located at the top of the spiral groove 68 and prevents over penetration of the plug 30 into the opening 22. The spiral groove walls 72 are tapered and unitary with the floor 74 of the spiral groove 68. The spiral groove floor 74 and spiral groove walls 72 end at the same ring at the bottom of the body portion 42. An open area 76 is created at the bottom of the body portion 42 where the spiral groove 68 ends.

The spiral groove 68 comprises a first groove boundary wall 78 and a second groove boundary wall 80, wherein the first groove boundary wall 78 transitions into the second groove boundary wall 80. The first groove boundary wall 78 is located in the region where the groove floor 74 is limited by spiral groove wall 72, while the second groove boundary wall 80 delimits the open area 76. The first groove boundary wall 78 angles downwardly from a horizontal line X. An angle β, is formed between the horizontal line X and the first groove boundary wall 78. The optimum range for β is between 10° and 25°. The second groove boundary wall 80 angles downwardly from a horizontal line Y. An angle α, is formed between the horizontal line Y and the second groove boundary wall 80. The optimum range for α is between 20° and 40°. In general, it is preferred that the angle of the groove boundary walls 78, 80 increases towards the bottom of the body portion 42.

As shown best in FIG. 3, the body portion 42 is substantially hollow. The hollow portion 81 is made up of two sections. The first upper part 82, or top section closest to the head portion 40, is smaller in diameter than the lower second part 84. The hollow portion 81 begins just below the lower second portion 48 of the head portion 40 and continues down the entire length of the drain plug 30. The hollow portion 81 does not extend into the head portion 40. The first upper part 82 of the hollow portion 81 is continuously connected to the lower second part 84 by a step 86, as shown in FIG. 3.

The end portion 44 of the plug 30, as depicted in FIGS. 3 and 5, is located below the body portion 42 and directly below an end of the first groove boundary wall 78. The outer diameter 90 of the end portion 44 is tapered to create an outer diameter that generally reduces in size as compared to the body portion 42. As depicted in FIG. 5, the first groove boundary wall 78 tapers into the tapered outer diameter of the end portion 44 of the plug 30. The second groove boundary wall 80 also ends and tapers into the tapered outer diameter of the end portion 44 of the plug 30. The end portion 44 of the plug 30 is also hollow.

The pan and drain plug assembly 10 may be made from thermoplastic and thermoset plastics, preferably with fibre-filling, especially glass-fibre filling. The most preferred is polyamide, especially PA 6 and PA 6.6. Thin parts, such as the raised collar 24 surrounding the opening 22 on the pan 12 and the thin sections of the plug 30 are preferably made from a non-foamed, solid material. In contrast, thicker parts of the pan can either be made from solid or foamed material, the latter being preferably produced by using the so-called MuCell procedure. The plug 30, without the o-ring 66, is preferably made from a polymer material, thus no metallic springs or the like are incorporated in the plug 30.

As shown in FIGS. 1 and 3, the plug 30 and o-ring 66 are inserted into the opening 22 of the oil pan 12. The tapering effect of the end portion 44 of the plug 30 assists in guiding the plug 30 into the opening 22. The nibs 38 engage with the spiral groove 68 to create a quick and efficient cam lock design to properly position the plug 30 in the opening 22 of the pan 12. When inserting the plug 30, the downwardly extending tabs 52 on the crown 50 rotate around the raised collar 24 where they finally rest in the cutouts 26 when the plug 30 is fully inserted in the opening 22. The cutouts 26 act as an exterior locking feature by receiving the downwardly extending tabs 52. The stop tabs 28 in turn prevent the plug 30 from being over tightened. In a preferred embodiment, the cutouts 26 have a width only somewhat larger than the width of the downwardly extending tab 52 to be received.

When removing the plug 30, the tapering of the end portion 44 also creates a free spin for easy removal of the drain plug 30 by easily disengaging the nibs 38 from the spiral groove 68. This disengagement is added by the fact that the spiral groove 68 does not extend into the end portion 44 of the drain plug 30, but ends in the open area 76 created at the bottom of the body portion 42. This feature also prevents damage to the nibs 38.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed is:

1. A plastic oil pan and plastic oil pan drain plug assembly, comprising:

a pan comprising upstanding walls, a bottom wall, an exterior surface and an interior surface, one of said walls comprising an opening extending from said exterior surface of said pan to said interior surface of said pan, said opening defined on said exterior surface of said pan by a generally circular raised collar, said raised collar comprising cutouts opposite each other and stop tabs located between said cutouts, said opening defined on said interior surface of said pan by a generally circular raised non-threaded tubular wall, a portion of said non-threaded tubular wall comprising nibs protruding into the opening;

a plastic drain plug comprising a head portion, a body portion, an end portion and an o-ring, said head portion comprising an upper first portion and a lower second portion, said upper first portion comprising an upstanding crown wherein said crown is partially defined by downwardly extending tabs located opposite each other, wherein said lower second portion of said head portion is smaller in diameter than said upper first portion, said body portion comprising a circular groove, said o-ring positioned within said circular groove, and a spiral groove located below said circular groove, said spiral groove comprising a upper groove boundary wall and a lower groove boundary wall, wherein said end portion of said plug comprises a tapered outer surface, and said end portion is located directly below an end of said upper groove boundary wall, said upper groove boundary wall is tapered into said tapered outer surface of said end portion, said lower groove boundary wall terminating above said end portion and is tapered into said end portion.

2. The plastic oil pan and plastic oil pan drain plug assembly as defined in claim 1, wherein said stop tabs are spaced equidistance from said cutouts.

3. The plastic oil pan and plastic oil pan drain plug assembly as defined in claim 1, wherein said collar and said non-threaded tubular wall are unitary with said pan.

4. The plastic oil pan and plastic oil pan drain plug assembly as defined in claim 1, wherein said nibs are triangularly shaped and unitary with triangular projections on an inner most edge of a straight edge.

5. The plastic oil pan and plastic oil pan drain plug assembly as defined in claim 1, wherein said cutouts define in part the smallest outer diameter of said collar.

6. The plastic oil pan and plastic oil pan drain plug assembly as defined in claim 1, wherein said stop tabs extend radially outward from said collar.

7. The plastic oil pan and plastic oil pan drain plug assembly as defined in claim 1, wherein said plug is a single unitary piece.

8. The plastic oil pan and plastic oil pan drain plug assembly as defined in claim 1, wherein said head portion of said drain plug comprises an indentation centered within a planar portion of said upper first portion.

9. The plastic oil pan and plastic oil pan drain plug assembly as defined in claim 1, wherein said head portion of said drain plug comprises a raised handle with planar sides that are parallel and fixed perpendicular to a planar portion of said upper first portion.

10. The plastic oil pan and plastic oil pan drain plug assembly as defined in claim 1, wherein said body portion of said plug is smaller in diameter than said lower second portion of said head portion of said plug.

11. The plastic oil pan and plastic oil pan drain plug assembly as defined in claim 1, wherein said body portion of said plug is substantially hollow.

12. The plastic oil pan and plastic oil pan drain plug assembly as defined in claim 11, wherein said hollow portion of said drain plug extends from an interior bottom surface of said lower second portion of said head portion and continues down the entire length of said drain plug, including through said end portion.

13. The plastic oil pan and plastic oil pan drain plug assembly as defined in claim 1, wherein said spiral groove comprises a first groove boundary wall that angles downwardly from a horizontal line X forming angle β.

14. The plastic oil pan and plastic oil pan drain plug assembly as defined in claim 13, wherein the range for angle β is between 10° and 25°.

15. The plastic oil pan and plastic oil pan drain plug assembly as defined in claim 1, wherein said spiral groove comprises a second groove boundary wall that angles downwardly from a horizontal line Y forming angle α.

16. The plastic oil pan and plastic oil pan drain plug assembly as defined in claim 15, wherein the range for angle α is between 20° and 40°.

17. The plastic oil pan and plastic oil pan drain plug assembly as defined in claim 1, wherein said opening is located in one of said upstanding walls of said pan.

18. A plastic oil pan and plastic oil pan drain plug assembly, comprising:

a pan comprising upstanding walls, a bottom wall, an exterior surface and an interior surface, one of said walls comprising an opening extending from said exterior surface of said pan to said interior surface of said pan, said opening defined on said exterior surface of said pan by a generally circular raised collar, said raised collar comprising cutouts opposite each other and stop tabs located between and spaced equidistance from said cutouts, said cutouts extend through the entire height of said raised collar, said stop tabs extend upwardly from said exterior surface of said pan and radially outward from an outside diameter of said raised collar, said opening defined on said interior surface of said pan by a generally circular raised non-threaded tubular wall, at least one nib projecting into said opening and an outer surface of said non-threaded tubular wall is partially hemispherical in shape;

a plastic drain plug comprising a head portion, a body portion, an end portion and an o-ring, said head portion comprising an upper first portion and a lower second portion, said upper first portion comprising an upstanding crown wherein said crown is partially defined by downwardly extending tabs located opposite each other, wherein said lower second portion of said head portion is smaller in diameter than said upper first portion, said body portion comprising a circular groove, said o-ring positioned within said circular groove, and a spiral groove located below said circular groove, said spiral groove comprises a first groove boundary wall that angles downwardly from a horizontal line X forming angle β, said spiral groove also comprises a second groove boundary wall that angles downwardly from a horizontal line Y forming angle α, said end portion of said plug comprises a tapered outer surface, and said end portion is located directly below an end of said first groove boundary wall, said first groove boundary wall is tapered into said tapered outer surface of said end portion, said second groove boundary wall terminating above said end portion and is tapered into said end portion of said plug.

19. The plastic oil pan and plastic oil pan drain plug assembly as defined in claim 18, wherein the range for angle β is between 10° and 25°.

20. The plastic oil pan and plastic oil pan drain plug assembly as defined in claim 18, wherein the range for angle α is between 20° and 40°.

21. A plastic oil pan drain plug, comprising:

a plastic drain plug comprising a head portion, a body portion, an end portion and an o-ring, said head portion comprising an upper first portion and a lower second portion, said upper first portion comprising an upstanding crown wherein said crown is partially defined by downwardly extending tabs located opposite each other, said crown is noncontinuous, said downwardly extending tabs are rectangular in shape and extend downwardly from said crown and adjacent the lower second portion of said head portion, said downwardly extending tabs are substantially flat and planar with a top of said crown before bending downward, an inside diameter of said crown transitions downward and is unitary with a planar portion, said lower second portion of said head portion is smaller in diameter than said upper first portion, said body portion is hollow and comprises a circular groove, said o-ring positioned within said circular groove, and a spiral groove located below said circular groove, wherein said circular groove is continuous and completely encircles an outer diameter of said body portion of said plug, said spiral groove comprises a first groove boundary wall that angles downwardly from a horizontal line X forming angle β, said spiral groove also comprises a second groove boundary wall that angles downwardly from a horizontal line Y forming angle α, said spiral groove walls are tapered and unitary with a floor of said groove, said end portion of said plug comprises a tapered outer surface, and said end portion is located directly below an end of said first groove boundary wall, said first groove boundary wall is tapered into said tapered outer surface of said end portion, said second groove boundary wall terminating above said end portion and is tapered into said end portion.

22. A plastic drain plug, comprising:

a plastic drain plug comprising a head portion, a body portion, and a tapered end portion, said head portion comprising an upper first portion and a lower second portion, said upper first portion comprising an upstanding crown wherein said crown is partially defined by downwardly extending tabs located opposite each other, said downwardly extending tabs extend downwardly from said crown and adjacent the lower second portion of said head portion, said lower second portion of said head portion is smaller in diameter than said upper first portion, said body portion comprises a sealing ring, circular groove and a spiral groove located below said circular groove, said spiral groove comprises a first groove boundary wall that angles downwardly from a horizontal line X forming angle β, said spiral groove also comprises a second groove boundary wall that angles downwardly from a horizontal line Y forming angle α, said end portion of said plug comprises a tapered outer surface, and said end portion is located directly below an end of said first groove boundary wall, said first groove boundary wall is tapered into said tapered outer surface of said end portion, said second groove boundary wall terminating above said end portion and is tapered into said end portion.

23. The plastic drain plug of claim 22, wherein angle $\alpha$ is greater than angle $\beta$.

24. The plastic drain plug of claim 22, wherein horizontal line Y is parallel to horizontal line X.

25. A plastic drain plug, comprising:

a head portion, a body portion, and a tapered end portion, said body portion comprises a sealing ring, circular groove and a spiral groove located below said circular groove, said spiral groove comprises a first wall that angles downwardly from a horizontal line X forming angle $\beta$, said spiral groove also comprises a second wall that angles downwardly from a horizontal line Y forming angle $\alpha$, wherein $\alpha$ is larger than $\beta$ and lines X and Y are parallel, said end portion of said plug comprises a tapered outer surface, and said end portion is located directly below an end of said first wall, said first wall is tapered into said tapered outer surface of said end portion, said second wall terminating above said end portion and is tapered into said end portion.

26. The plastic drain plug of claim 25, wherein said body portion has a smaller outer diameter than an outer diameter of said head portion.

27. The plastic drain plug of claim 25, wherein said circular groove is located in an upper third of said body portion and said spiral groove is located in a lower two thirds of said body portion.

28. The plastic drain plug of claim 25, wherein a stop is located at the beginning of the spiral groove.

29. The plastic drain plug of claim 25, wherein said spiral groove has tapered walls.

30. The plastic drain plug of claim 25, wherein said first wall transitions into said second wall.

31. The plastic drain plug of claim 25, wherein said body portion is hollow.

32. The plastic drain plug of claim 25, wherein angle $\beta$ is between 10° and 25°.

33. The plastic drain plug of claim 25, wherein angle $\alpha$ is between 20° and 40°.

* * * * *